US006764157B2

(12) United States Patent
Lee et al.

(10) Patent No.: US 6,764,157 B2
(45) Date of Patent: Jul. 20, 2004

(54) IMAGE FORMING DEVICE CORRECTING VERTICAL ALIGNMENTS AND CORRECTION METHOD THEREOF

(75) Inventors: Yong-duk Lee, Gunpo (KR); Hyun-ki Park, Youngin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/405,606

(22) Filed: Apr. 3, 2003

(65) Prior Publication Data

US 2003/0222932 A1 Dec. 4, 2003

(30) Foreign Application Priority Data

May 31, 2002 (KR) ..... 2002-30690

(51) Int. Cl.[7] ..... B41J 29/38; B41J 29/393

(52) U.S. Cl. ..... 347/16; 347/19

(58) Field of Search ..... 347/16, 14, 23, 347/12, 43, 4, 8, 38, 104, 37, 39, 5, 106, 19, 10, 11, 40; 226/170, 145

(56) References Cited

U.S. PATENT DOCUMENTS 5,801,722 A * 9/1998 Ueda et al. ..... 347/16

6,074,054 A * 6/2000 Katsuyama ..... 347/104

* cited by examiner

*Primary Examiner*—Stephen D. Meier
*Assistant Examiner*—Charles Stewart, Jr.
(74) *Attorney, Agent, or Firm*—Staas & Halsey LLP

(57) ABSTRACT

An image forming device has a first calculator applying any one of setting values for plural alignment patterns pre-set corresponding to magnitudes of feeding error values according to feeding amounts of a printing sheet of paper by feeding rollers and calculating first correction values for the feeding error values depending upon operation modes, a second calculator calculating second correction values for the feeding error values depending upon the printing sheet, and a controller controlling the feeding rollers to be driven to correct the feeding error values depending upon the operation modes and the printing sheet using the first and second correction values calculated by the first and second calculators. Accordingly, the image forming device can correct the feeding error values depending upon the operation modes, the printing sheet, and the printing position sections, thereby obtaining a best quality images in the respective modes.

35 Claims, 7 Drawing Sheets

IMAGE FORMING DEVICE CORRECTING VERTICAL ALIGNMENTS AND CORRECTION METHOD THEREOF

CROSS-REFERENCE TO RELATED APPLICATIONS

This application claims the benefit of Korean Patent Application No. 2002-30690, filed May 31, 2002, in the Korean Intellectual Property Office, the disclosure of which is incorporated herein by reference.

BACKGROUND OF THE INVENTION

1. Field of the Invention

The present invention relates to an image forming device, and more particularly, to an image forming device capable of correcting vertical alignments, and a correction method thereof.

2. Description of the Related Art

In general, an image forming device, such as a photocopier, a scanner, a printer, and so on, picks up a sheet of printing paper one by one from a paper-supplying cassette, passes the printing sheet through predetermined traveling passageways, and moves the printing sheet to a feeding position where feeding rollers are driven to feed the printing sheet. The printing sheet positioned in the feeding position travels at a proper time and feeding speed by the feeding rollers driven by a controller upon a print command and is printed with images by a printer head.

For example, in a case that dots of the printer head are 832 dots±0.016 (0.5 dot/800 dpi) and in a case of 1 pass of the 832 dots, a rotation radius or distance of a feeding roller (outer circumference CD=56.8 mm) is theoretically the same as the following Formula 1.

$$\text{Size of a dot} = \frac{1\text{ inch}}{800} = 0.03175\text{ mm 1 pass} = 832\text{ dots} \qquad \text{Formula 1}$$

$$\text{Total size of 832 dots} = 0.03175 \times 832 = 26.416\text{ mm}$$

$$\text{turn: 1 pass} = \frac{26.416}{56.80} = 0.46507$$

That is, in a case that the printer head makes one pass, the feeding rollers make about a half turn. However, the above result is a theoretical result, such as a tolerance error ($\pm\phi 0.02\pi$) occurring due to a diametric allowance of the feeding rollers, and a structural error, that is, a vertical alignment, produces white lines and black lines.

The white lines and black lines deteriorate a quality of images formed by the image forming device. In order to solve the above problem, a conventional image forming device corrects feeding error values using a predetermined correction value selected by a user.

However, the feeding error values are different depending upon print modes, printing sheets (thickness), and printing position sections of printing sheets, so that the feeding error values should be corrected depending upon respective modes in order to correct the feeding error values more precisely.

In general, operation modes, referred to as the 'print modes' hereinafter, of a printer are divided into print quality modes, such as Draft (full swath), Normal (full swath*½), Quality (full swath*¼), and Best (full swath*⅛, ⅙), and the printing sheets of paper are classified into Plain, Glossy, Transparency, Special Media, and so on, according to their thickness. For example, a thickness of the printing sheets is different from others and ranges from 0.1 mm at minimum to 0.67 at maximum or so. Further, the printing position sections of the printing sheets are divided into a first section where a printing sheet is inserted in a pickup roller and feeding rollers, a second section where the printing sheet is inserted in the pickup roller, the feeding rollers, and exit rollers, a third section where the printing sheet is inserted in the feeding rollers and the exit rollers, and a fourth section where the printing sheet is inserted in the exit rollers, and over-feeding of the printing sheet occurs at the instant that the printing sheet is inserted in respective sections.

Accordingly, the conventional corrections for the feeding error values have been made using the predetermined correction value in a lump with respect to the feeding error values appearing different depending upon the print modes, the printing sheets, and the printing position sections, so that the corrections for the feeding error values have not been accurately made.

SUMMARY OF THE INVENTION

In order to solve the above and/or other problems, it is an aspect of the present invention to provide an image forming device and a correction method thereof which enable feeding error values (vertical alignments) to be corrected depending upon, firstly, print modes, secondly, printing sheets, and, thirdly, printing position sections for the printing sheets.

Additional aspects and advantages of the invention will be set forth in part in the description which follows and, in part, will be obvious from the description, or may be learned by practice of the invention.

In order to achieve the above and/or other aspects, an image forming device according to an embodiment of the present invention includes a first calculator applying one of setting values for plural alignment patterns pre-set in accordance with magnitudes of feeding error values corresponding to feeding amounts of a printing sheet of paper by feeding rollers to calculate first correction values for the feeding error values depending upon operation modes, a second calculator calculating second correction values for the feeding error values depending upon the printing sheet, and a controller controlling the feeding rollers to be driven to correct the feeding error values depending upon the operation modes and the printing sheet using the first and second correction values calculated by the first and second calculator.

Further, the image forming device includes an input part inputting the setting values corresponding to the feeding error values and a detector detecting the feeding error values, and the first and second calculators calculate the first and second correction values depending upon the operation modes and the printing sheet, respectively, using the setting values.

In the meantime, the image forming device has a printing position section divided into a first section where the printing sheet of paper is inserted in a pickup roller and feeding rollers, a second section where the printing sheet is inserted in the pickup roller, the feeding rollers, and exit rollers, a third section where the printing sheet is inserted in the feeding rollers and the exit rollers, and a fourth section where the printing sheet is inserted in the exit rollers, and the first and second calculators apply the setting values corresponding depending upon the printing position sections from the setting values of the plural pre-set alignment patterns to calculate the correction values for the feeding error values depending upon the operation modes and the printing sheet. The controller controls the feeding rollers to be driven to correct the feeding error values depending upon the printing position sections, the operation modes, and the printing sheet using the correction values calculated by the first and second calculators.

In the meantime, a vertical alignment correction method for an image forming device includes printing plural alignment patterns pre-set according to magnitudes of feeding error values corresponding to feeding amounts of a printing sheet of paper by feeding rollers, inputting predetermined setting values for the feeding error values, calculating correction values for the feeding error values depending upon the predetermined setting values inputted, and correcting the feeding error values depending upon the operation modes using the calculated correction values.

Accordingly, the image forming device and the correction method thereof can correct the feeding error values depending upon the operation modes, the printing sheets, and the printing position sections, to enable best quality images to be obtained in respective modes.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
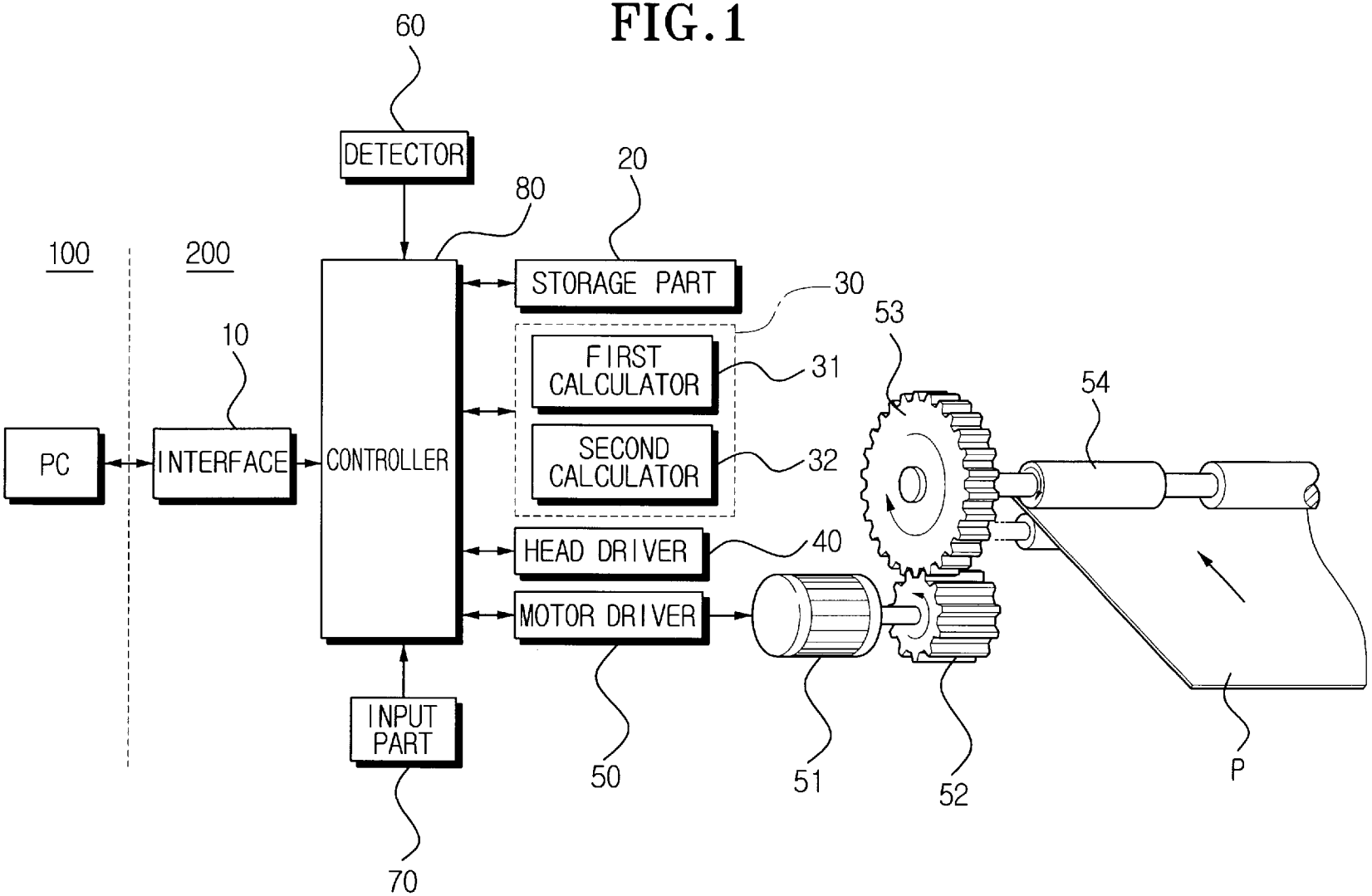
FIG. 1 is a block diagram schematically showing an inkjet printer according to an embodiment of the present invention.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 4:
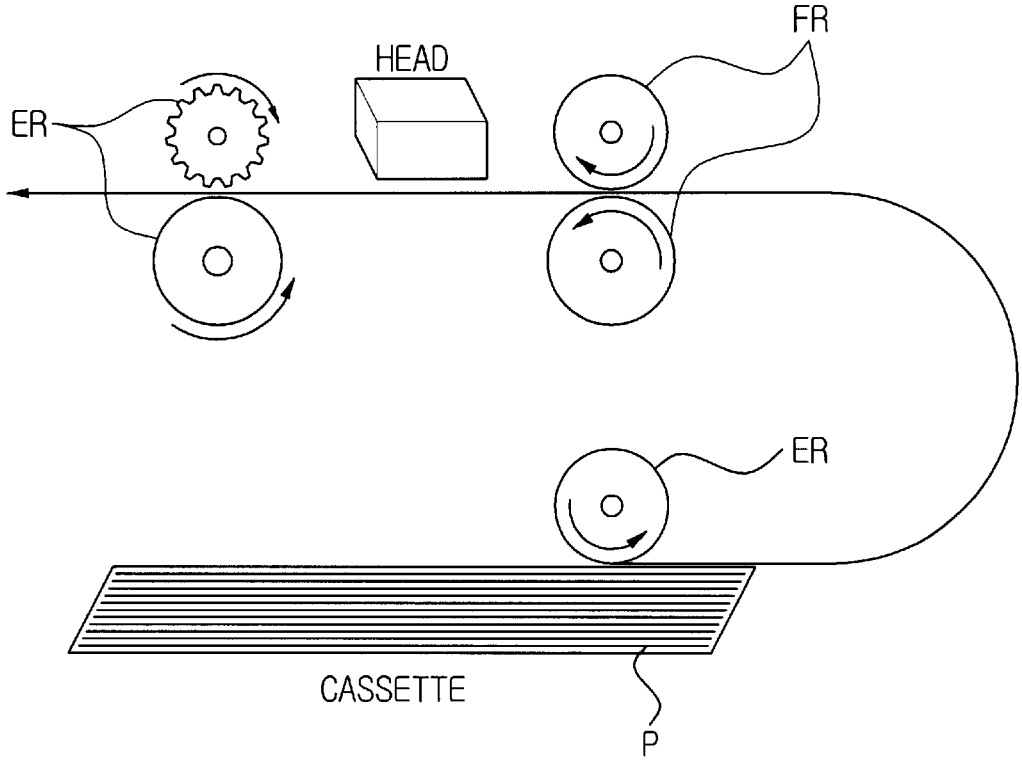
FIG. 4 is a view schematically showing a roller arrangement state in a C-path type of the inkjet printer shown in FIG. 1.

In general, image forming devices, such as printers, are classified into a C-path (Front Input/Front Output), a bin-path (Rear Input/Front output), and a single sheet input (SSI) or manual path depending on paper-supplying directions of printing sheets of printing paper, and an inkjet printer 200 having the C-path is described in FIGS. 1 and 4 according to an embodiment of the present invention.

The inkjet printer 200 has an interface 10, a storage part 20, a calculator 30, a head driver 40, a motor driver 50, a detector 60, an input part 70, a controller 80, and so on as shown in FIG. 1.

The interface 10 receives printing data and printing commands from a computer (PC) 100, and the received printing data is stored in the storage part 20.

The calculator 30 has a first calculator 31 and a second calculator 32 to determine first and second calculate correction values, respectively, for feeding error values based on print modes and the printing sheets.

The first calculator 31 calculates the first correction values for the feeding error values depending on the print modes based on Table 1, and the second calculator 32 calculates the second correction values for the feeding error values depending on the printing sheets based on Formula 2.

TABLE 1

| Print mode | Feeding Amount |
|---|---|
| Draft | Normal Feed Distance + Delta |
| Normal | Normal Feed Distance + Delta − (Delta * sin(45) * alpha) |
| Quality | Normal Feed Distance + Delta − (Delta/sin(67.5) * alpha) |
| Best | Normal Feed Distance + Delta − (Delta/sin(80) * alpha) |

Figure 2A:
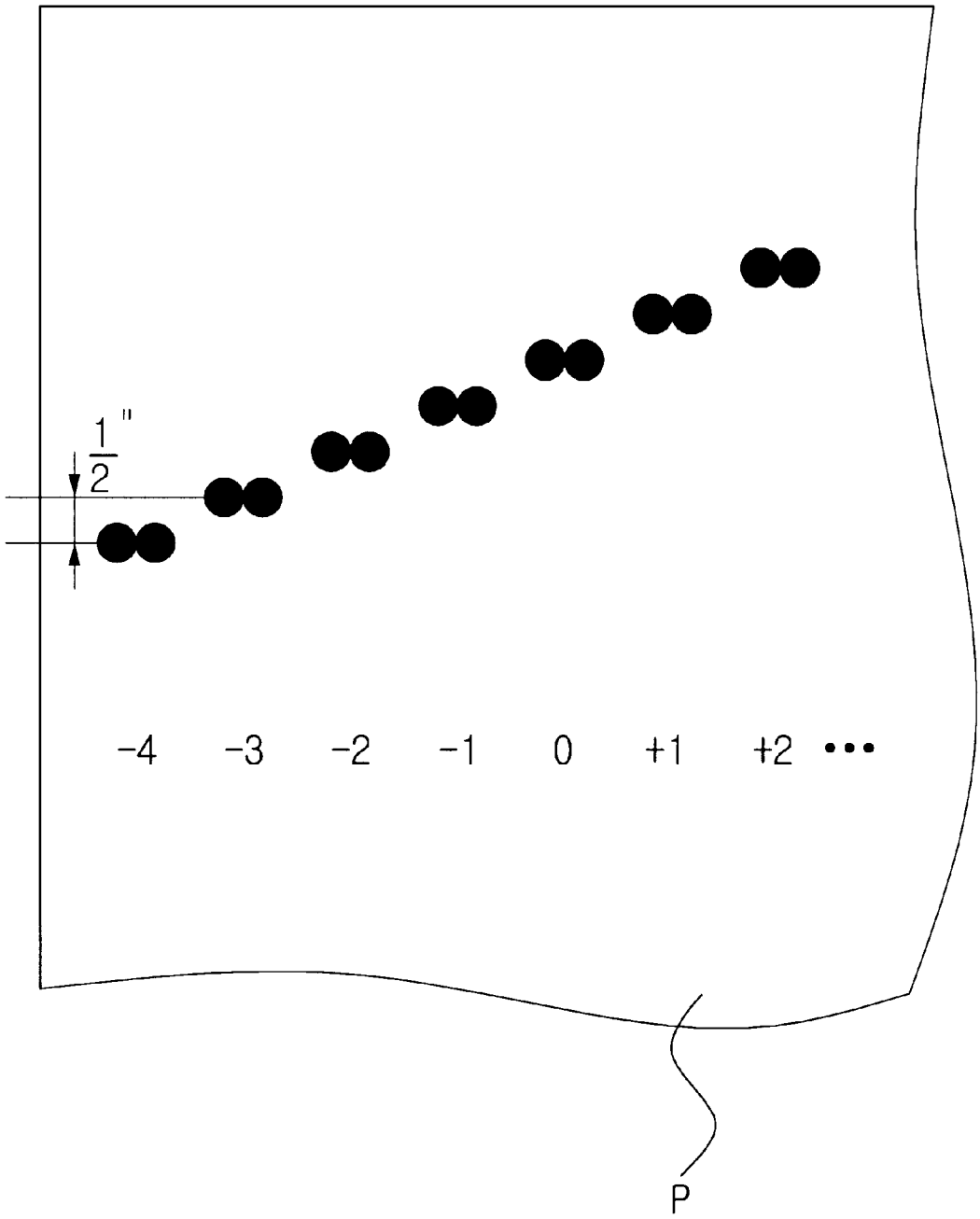
FIGS. 2A to 2C are views showing states comparing feeding error values based on alignment patterns.

Delta indicates a setting value ( . . . , −3, −2, −1, 0, 1, 2, 3, . . . ) based on a predetermined alignment pattern shown in FIG. 2A, and alpha indicates an experimental value.

Formula 2

Figure 3:
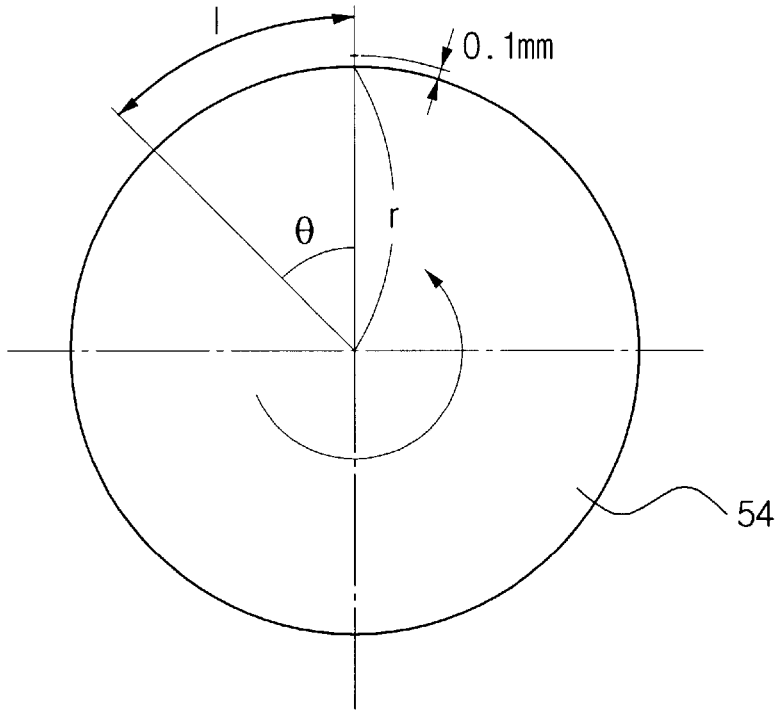
FIG. 3 is a view explaining a rotation amount of feeding rollers based on a thickness of a printing sheet of paper in the inkjet printer shown in FIG. 1.

Feeding amount=Norminal feed distance+I, I=(r+Δ sheet thickness)θ, wherein r and θ are a radius and an angle shown in FIG. 3, respectively.

As described above, the first and second correction values for the feeding error values for print modes and the printing sheets are calculated based on the respective print modes and printing sheets by the first and second calculators 31 and 32.

The head driver 40 drives nozzles of the printer head (not shown) in accordance with the printing data stored in the storage part 20 to output the printing data on the printing sheets.

The motor driver 50 rotates a feeding roller 54 and corrects a feeding amount of each printing sheet according to a correction value for a feeding error value calculated in the calculator 30. The motor driver 50 drives a step motor 51 connected to a drive gear 52. The drive gear 52 is meshed with a driven gear 53 mounted on a rotation shaft of the feeding roller 54, and the drive gear 52 has a gear ratio to make predetermined integer-multiple turns when the driven gear 53 makes one turn.

The input part 70 is, in general, provided with an operation panel (not shown) to allow a user to input operation commands for operations of the printer 200, for example, when the user intends to change an alignment setting mode, the user inputs the setting value for the feeding error value of the alignment pattern as described above.

Further, the detector 60 detects a feeding amount error in comparison of the feeding amount based on a printing state ongoing at present with the alignment pattern (shown in FIG. 2A) during switching alignment setting modes. At this time, the controller 80 provides the first calculator 31 with a predetermined setting value corresponding to a detected error to calculate the correction value for the feeding error value depending on respective print modes. Further, the second calculator 32 calculates the correction value for the feeding error value depending on the printing sheets.

Figure 2B:
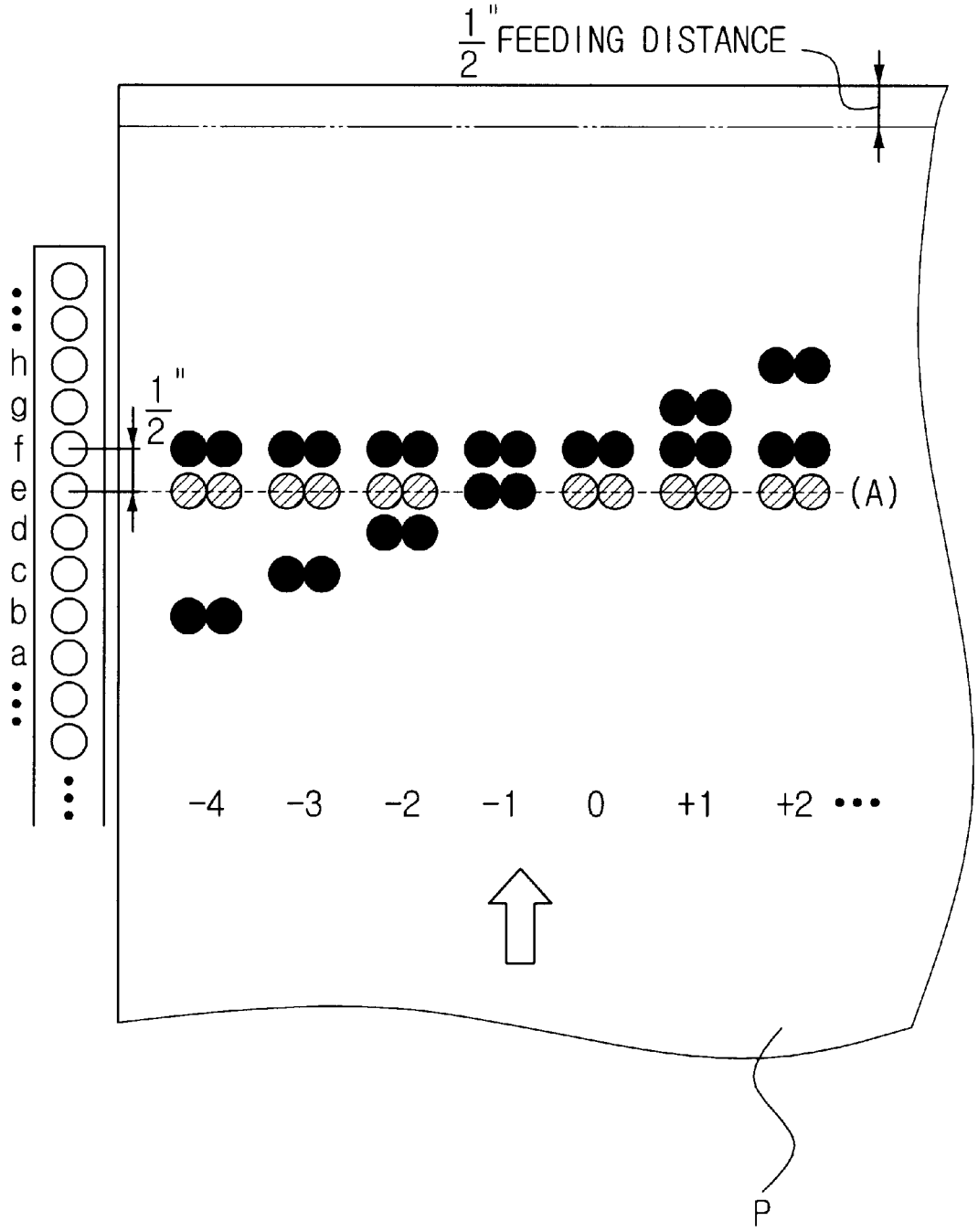
Figure 2C:
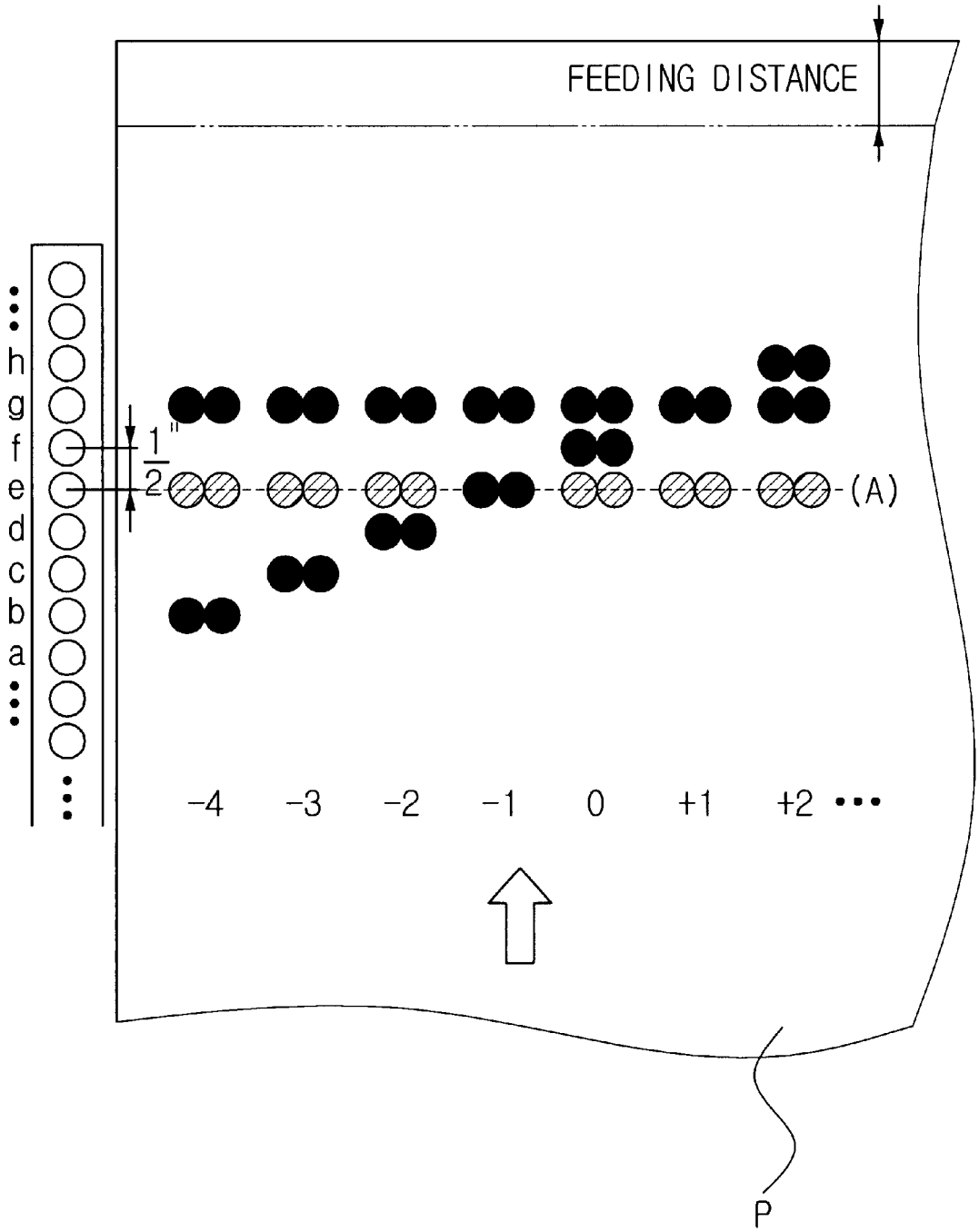

A detailed description is made on vertical alignment corrections according to alignment patterns with reference to FIGS. 2A to 2C.

First, when the alignment setting modes are switched, the controller 80 drives a predetermined nozzle "e" of a plurality of nozzles of a printer head of 800 dpi, for example, to print a reference line A shown in FIG. 2B. Thereafter, the controller 80 feeds a printing sheet P by a predetermined distance. For example, the controller 80 rotates feeding rollers 54 to feed the printing sheet P by the predetermined distance of half an inch. After that, the controller 80 drives a nozzle "f" half an inch away from the reference line A formed by the nozzle "e" and drives nozzles . . . , b, c, d, e and g, h, i, j . . . another predetermined distance away from another line formed by the nozzle "f" upwards and downwards to print the alignment pattern shown in FIG. 2A along the reference line A as shown in FIG. 2B. The predetermined distance may be the same as the another predetermined distance.

At this time, if the printing sheet P is precisely fed by a predetermined feeding distance of half an inch, the another line printed by the nozzle "f" is overlaid on another line, e.g., the reference line A, to be printed when the setting value of the reference line A is '0'. Accordingly, a user and the detector 60 decide that the feeding amount is accurate at present according to a rotation amount of the feeding rollers 54.

However, as shown in FIG. 2C, if a pattern printed by the nozzle "g" is overlaid on the reference line A, the user and the detector 60 decide that the feeding error value occurs. Accordingly, the user inputs through the input part 70 a setting value '+1' for the feeding error value based on the alignment pattern of FIG. 2A. That is, if the setting value '+1' is manually inputted from the user, the controller 80 provides the inputted setting value to the first calculator 80, and the first calculator 31 calculates the correction value for the feeding error value depending on the respective print modes corresponding to the inputted setting value.

Further, the feeding error value is automatically detected by the detector 60, and the first calculator 31 calculates the first correction value for the feeding error value depending on the print modes. As such, in a case that the correction value for the feeding error value is automatically calculated, on a basis that the nozzles of a printer head of 800 dpi, for example, are arranged at a certain interval, the detector 60 detects which one of the nozzles prints a pattern overlaid on the reference line A after the nozzle "e", for example is driven, and the printing sheet is fed by half an inch. Accordingly, the controller 80 selects the setting value corresponding to the feeding error value according to a difference, e.g., a distance, between the nozzle "f", for example, and the nozzle "e". Therefore, the first calculator 31 calculates the correction value for the feeding error value depending on the respective print modes based on equations shown in Table 1 corresponding to the setting value '+1'.

Further, during switching the alignment setting modes, if the controller 80 distinguishes kinds of the printing sheets in use and provides thickness differences of the respective printing sheets to the second calculator 32, the second calculator 32 can calculate the second correction value for the feeding error value depending on the printing sheets based on the equation of Formula 2.

For example, in a case that the printing sheets of paper used upon switching the alignment setting modes are plain paper (as thick as about 0.1 mm), as shown in FIG. 3, a feeding amount (I) for the correction is represented by $I=(r+0.1)\theta$. Further, in a case that the printing sheets of paper are Glossy paper (as thick as about 0.25 mm), the feeding amount (I) for the correction is represented by $I=(r+0.1+\Delta$ sheet thickness$)\theta$ wherein the $\Delta$ sheet thickness becomes 0.15 mm. As such, the second calculator 32 can calculate the second correction value for the feeding error value depending on the respective printing sheets.

Thereafter, the controller 80 controls the motor driver 50 based on the first and second correction values calculated depending on the respective print modes and printing sheets, controls the rotation amount of the feeding rollers 54, and controls the feeding amount of a printing sheet P.

A correction method using one alignment pattern has been described to correct the feeding error values occurring depending on the print modes and the printing sheets. However, the feeding error values also occur depending on a section-by-section state till printing is completed through a pickup roller PR, feeding rollers FR, and exit rollers ER, from a paper-supplying cassette in which the printing sheets are loaded.

Another method of correcting the feeding error values occurring depending on printing position sections in the inkjet printer shown in FIGS. 1 and 4 is as follows.

FIG. 4 is a view schematically showing a C-path structure, for example, of passageways classified based on input directions of printing sheets P.

If a print command is inputted from a user, a printing sheet P loaded in a paper-supplying cassette CS is picked up by the pickup roller PR and moves along a transfer passageway, a the front end of the printing sheet P traveling along the transfer passageway is inserted in the feeding rollers FR. From this time, a printer head HEAD operates to start printing the printing sheet P. After a certain period of time lapses, the printing sheet P is inserted into the pickup roller PR, the feeding rollers FR, and the exit rollers ER in order and printed by the printer head HEAD, and, next, the printing sheet P is inserted into the feeding rollers FR and exit rollers ER, and, finally, inserted into only the exit rollers ER, to finalize a printing operation.

As such, the printing position sections are divided depending on where the printing sheet P is located into a first section PR-FR where the printing sheet P is inserted in the pickup roller PR and the feeding rollers FR, a second section PR-FR-ER where the printing sheet P is inserted in the pickup roller PR, the feeding rollers FR, and the exit rollers ER, a third section FR-ER where the printing sheet P is inserted in the feeding rollers FR and the exit rollers ER, and a fourth section ER where the printing sheet P is inserted in the exit rollers ER. When the printing sheet P travels through the respective printing position sections, a phenomenon occurs that the printing sheet P is abruptly overfed due to a drag force occurring by the respective rollers PR, FR, and ER.

Accordingly, when alignment setting modes are switched, an alignment of the printing sheet P is set in every printing position section to eliminate the white lines between printed (black) lines occurring due to such overfeeding. That is, like using the alignment patterns to correct the feeding error values depending on the print modes as described above, four alignment patterns are provided for the respective printing position sections to apply (select) one of setting values for the feeding error values. The setting values can be inputted, as described above, manually through the input part 70 or automatically through the detector 60.

Figure 5:
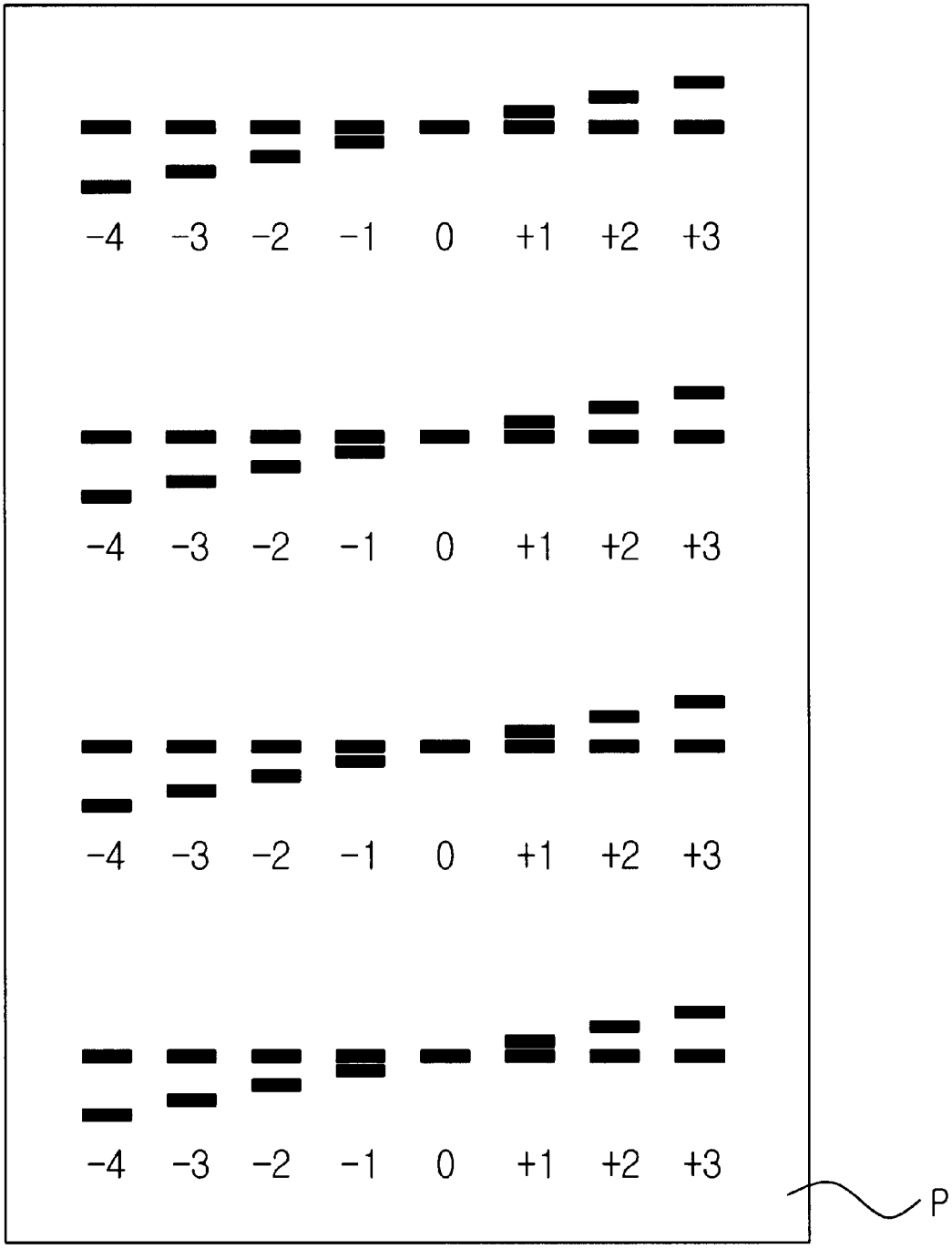
FIG. 5 is a view showing the printing sheet on which an alignment pattern is formed depending upon respective printing position sections of FIG. 4.

As shown in FIG. 5, four alignment patterns are formed on the printing sheet P for the respective printing position sections, and the setting values are inputted to correspond to the feeding error values appearing on the respective alignment patterns. The four alignment patterns are the same since the feeding error values are calculated according to a location of the printing sheet P in the respective printing position sections. Accordingly, the first calculator 31 calculates first correction values depending on the print modes in the printing position sections corresponding to the respective setting values. The controller 80 stores the calculated first correction values for the feeding error values depending on the print modes in the printing position sections, and, when printing, controls the motor driver 50 in accordance with the corresponding first correction values.

Further, the second calculator 32 distinguishes the kinds of printing sheets in use, calculates thickness differences of respective printing sheets, and calculates second correction values for the feeding error values depending on the printing sheets.

Accordingly, the second correction values can be applied depending on the printing position sections, the print modes, and the printing sheets to correct optimum states of the feeding error values which may occur in the respective occasions.

Figure 6:
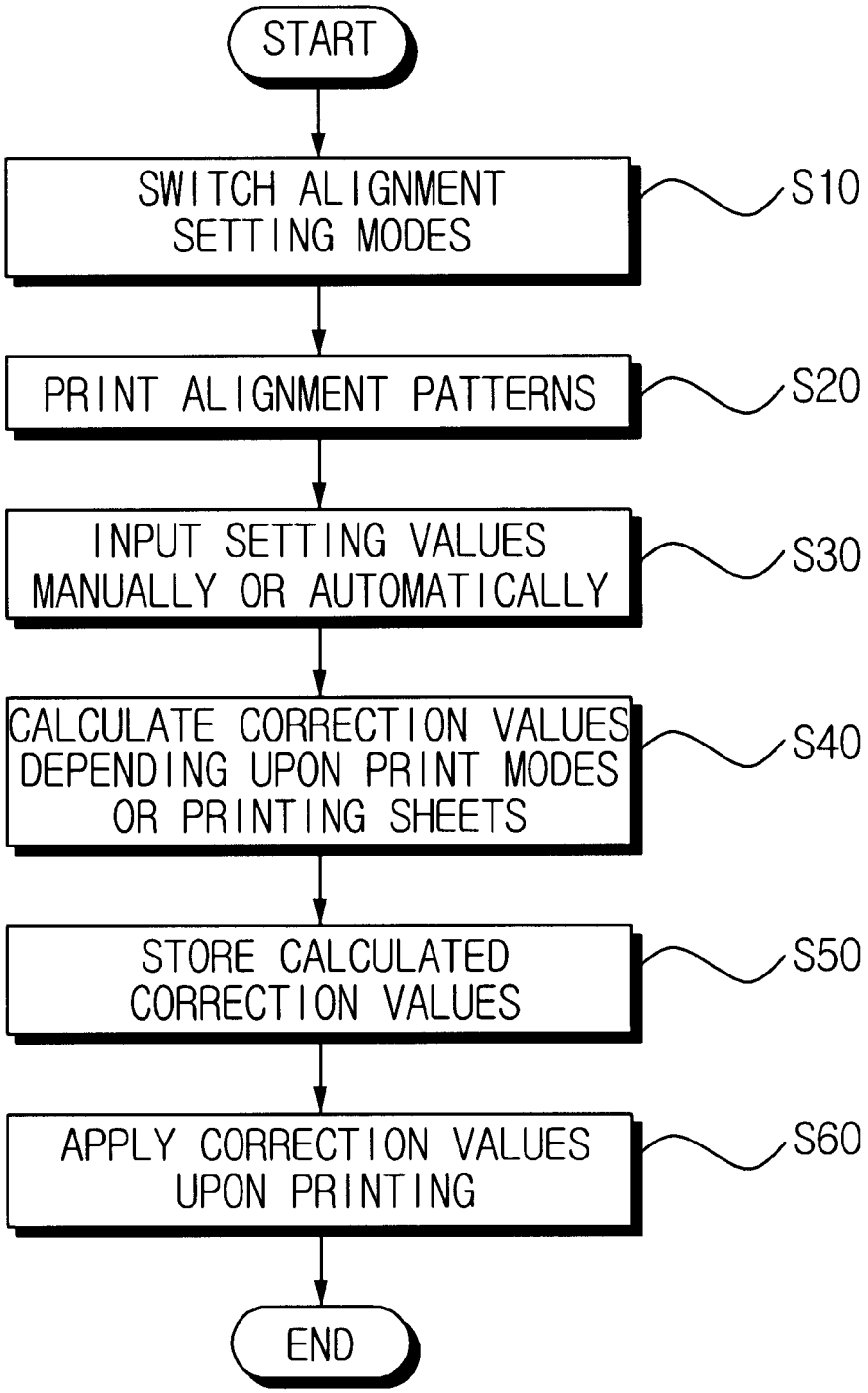
FIG. 6 is a flow chart showing a method of correcting a vertical alignment in the inkjet printer of FIG. 1.

The method of correcting the feeding error values depending on the respective print modes, the printing sheets, and the printing position sections in the inkjet printer shown in FIG. 1 and having the structure as above is described with reference to FIG. 6.

First, the user switches to a setting mode to perform alignment setting in operation S10. Thereafter, the user uses a predetermined print sheet of plain paper to print alignment patterns as shown in FIG. 2A to FIG. 2C in operation S20. For example, as shown in FIG. 2C, in a case that a feeding error value corresponding to a setting value '+1' occurs, the user inputs the setting value '+1' through the input part 70 in operation S30. The detector 60 may automatically detect an alignment pattern and detects the feeding error value in operation S30. The controller 30 provides to the first calculator 31 the inputted setting value '+1' and/or the setting value '+1' corresponding to the feeding error value detected by the detector 60. The first calculator 31 calculates the first correction values for the feeding error value depending upon the respective print modes according to the setting value '+1' in operation S40. Further, the second calculator 32 calculates the second correction values for the feeding amounts depending upon the printing sheets in operation S40. The controller 80 stores in the storage part 20 the calculated second correction values depending upon the respective print modes and printing sheets in operation S50, when printing, applies the calculated first and/or second correction values depending upon the respective print modes and printing sheets to the motor drive 50, and controls the motor driver 50 in operation in S60. By the control of the controller 80, the motor driver 50 controls the step motor 51 to drive the drive gear 52 so as to control the rotation amounts of the driven gear 53 and the feeding rollers 54, to thereby correct feeding error values. Accordingly, the feeding error values deteriorating a printing quality due to the white lines and black lines can be corrected to an optimum state depending upon the print modes and the printing sheets.

In the meantime, in order to set alignments depending upon the printing position sections, in operation S20, the alignment patterns are printed respectively depending upon the first section PR-FR where the printing sheet is inserted in the pickup roller PR and the feeding rollers FR, the second section PR-FR-ER where the printing sheet is inserted in the pickup roller PR, feeding rollers FR, and exit rollers ER, the third section FR-ER where the printing sheet is inserted in the feeding rollers FR and the exit rollers ER, and the fourth section ER where the printing sheet is inserted in the exit rollers ER.

Thereafter, in operation S30, the feeding error values are corrected in the same manner as in operation S60.

So far, the description has been made on a printer having the C-path structure in the printing sheet input direction, but, even in the bin-path (Rear Input/Front output) and the SSI path, the feeding error values can be corrected depending upon the respective printing modes as described above by applying different drag forces to the respective sections.

Accordingly, the feeding error values are corrected to the optimum state depending on the printing position sections, the print modes, and the printing sheets so that the white and black lines, which occur due to vertical alignment difference, are eliminated.

With the present invention, the feeding error values can be corrected depending upon the print modes, the printing sheets, and the printing position sections.

Accordingly, the feeding error values, that is, vertical alignments, can be corrected in an optimum condition according to the respective printing modes, thereby obtaining a best image quality.

Although the preferred embodiment of the present invention has been described, it will be understood by those skilled in the art that the present invention should not be limited to the described preferred embodiment, but various changes and modifications can be made within the spirit and scope of the present invention as defined by the appended claims and their equivalents.

What is claimed is:

1. An image forming device having a feeding roller feeding a printing sheet, comprising:

a first calculator applying one of setting values for plural alignment patterns pre-set in accordance with magnitudes of feeding error values of feeding amounts of a printing sheet of paper by the feeding roller to calculate first correction values for the feeding error values depending upon operation modes; and a controller controlling the feeding roller to be driven to correct the feeding error values depending upon the operation modes in accordance with the first correction values calculated by the first calculator.

2. The image forming device as claimed in claim 1, further comprising an input part through which the setting values corresponding to the feeding error values are input, wherein the first calculator calculates the first correction values for the feeding error values depending upon the operation modes in accordance with the setting values inputted through the input part.

3. The image forming device as claimed in claim 1, further comprising a detector detecting the feeding error values, wherein the first calculator calculates the first correction values depending upon the operation modes corresponding to the feeding error values detected by the detector.

4. The image forming device as claimed in claim 1, further comprising a second calculator calculating second correction values for the feeding error values depending upon the printing sheet, wherein the controller controls the feeding roller to be driven to correct the feeding error values depending upon the operation modes and the printing sheet corresponding to the first and second correction values calculated by the first and second calculators.

5. An image forming device having printing position sections divided into a first section where a printing sheet of paper is inserted in a pickup roller and a feeding roller, a second section where the printing sheet is inserted in the pickup roller, the feeding roller, and an exit roller, a third section where the printing sheet is inserted in the feeding roller and the exit roller, and a fourth section where the printing sheet is inserted in the exit roller, comprising:

a first calculator applying setting values depending upon the printing position sections from setting values of plural alignment patterns pre-set in accordance with magnitudes of feeding error values for feeding amounts of the printing sheet by the feeding roller to calculate first correction values for the feeding error values depending upon operation modes; and a controller controlling the feeding roller to be driven to correct the feeding error values depending upon the printing position sections and the operation modes in accordance with the correction values calculated by the first calculator.

6. The image forming device as claimed in claim 5, further comprising an input part through which the setting values depending upon the printing position sections are input, wherein the first calculator calculates the first correction values for the feeding error values depending upon the printing position sections and the operation modes corresponding to the setting values inputted through the input part.

7. The image forming device as claimed in claim 5, further comprising a detector detecting the feeding error values depending upon the printing position sections, wherein the first calculator calculates the first correction values depending upon the printing position sections and the operation modes in accordance with to the feeding error values detected by the detector.

8. The image forming device as claimed in claim 5, further comprising a second calculator calculating second correction values for the feeding error values depending upon the printing sheet, wherein the controller controls the feeding roller to be driven to correct the feeding error values depending upon the printing position sections, the operation modes, and the print sheet in accordance with the first and second correction values calculated by the first and second calculators.

9. A vertical alignment correction method for an image forming device, the method comprising:

printing plural alignment patterns pre-set in accordance with magnitudes of feeding error values for feeding amounts of a printing sheet of paper by a feeding roller;

inputting predetermined setting values for the feeding error values corresponding to the plural alignment patterns;

calculating correction values for the feeding error values depending upon the predetermined setting values inputted; and correcting the feeding error values depending upon the operation modes in accordance with the calculated correction values.

10. The vertical alignment correction method as claimed in claim 9, further comprising:

detecting the predetermined feeding error values, wherein the calculating of the correction values comprises calculating the correction values depending upon the operation modes in correspondence to the detected feeding error values.

11. The vertical alignment correction method as claimed in claim 9, wherein the calculating of the correction values comprises:

correcting the feeding error values depending upon the operation modes and the printing sheet in correspondence to the calculated correction values.

12. A vertical alignment correction method for an image forming device having printing position sections divided into a first section where a printing sheet is inserted in a pickup roller and feeding rollers, a second section where the printing sheet is inserted in the pickup roller, the feeding rollers, and exit rollers, a third section where the printing sheet is inserted in the feeding rollers and the exit rollers, and a fourth section where the printing sheet is inserted in the exit rollers, the method comprising:

printing depending upon the printing position sections plural alignment patterns pre-set in accordance with magnitudes of feeding error values for feeding amounts of the printing sheet by the feeding rollers;

inputting the setting values corresponding to the feeding error values depending upon the printing position sections;

calculating correction values for the feeding error values depending upon the printing position sections and the operation modes; and correcting the feeding error values depending upon the printing position sections and the operation modes corresponding to the calculated correction values.

13. The vertical alignment correction method as claimed in claim 12, wherein the calculating of the correction value comprises calculating the correction values for the feeding error values depending upon the printing sheet, and the correcting of the feed error values comprises:

correcting the feeding error values depending upon the printing position sections, the operation modes, and the printing sheet in accordance with the calculated correction values.

14. An image forming device feeding a printing sheet of paper using rollers including a pickup roller, a feeding roller, and an exit roller, comprising:

a calculator calculating an error correction value according to the number of the rollers feeding the printing sheet; and a controller driving the feeding roller according to the error correction value of the calculator.

15. The image forming device as claimed in claim 14, wherein the calculator calculates the error correction value according to one of printing modes.

16. The image forming device as claimed in claim 14, wherein the calculator calculates the error correction value according to a characteristic of the printing sheet.

17. The image forming device as claimed in claim 16, wherein the characteristic of the printing sheet is a thickness of the printing sheet.

18. The image forming device as claimed in claim 14, wherein the device comprises an input part through which a setting value is input, and the controller drives the feeding roller according to the setting value.

19. The image forming device as claimed in claim 14, wherein the device comprises a printer head having a plurality of nozzles, and the controller controls the printer head to print patterns using respective nozzles while feeding the printing sheet, and controls the feeding roller to feed the printing sheet according to a characteristic of the pattern.

20. The image forming device as claimed in claim 14, wherein the device comprises a printer head having a plurality of nozzles to print a pattern on the printing sheet, and a detector detecting a characteristic of the pattern, the calculator calculates a feeding error correction signal in accordance with the characteristic of the pattern, and the controller drives the feeding roller to feed the printing sheet according to the feeding error correction signal.

21. The image forming device as claimed in claim 20, wherein the pattern comprises lines formed by dots, the detector detects whether one of the lines is overlaid on an other one of the lines, and the calculator calculates the feeding error correction signal upon detecting that the one of the lines is overlaid on the other one of the lines.

22. The image forming device as claimed in claim 20, wherein the nozzles comprises a reference nozzle and other nozzles spaced-apart from the reference nozzle by respective distances, the pattern comprises a reference line formed by the reference nozzle and other lines formed by the other nozzles during feeding the printing sheet, and the detector detects the characteristic of the reference line and the other lines representing that one of the other lines is overlaid on the reference line, the calculator calculates the feeding error correction signal in accordance with the characteristic of the reference line and the other lines, and the controller drives the feeding roller to feed the printing sheet according to the feeding error correction signal.

23. The image forming device as claimed in claim 22, wherein the detector detects a distance between the reference line and one of the other lines which is overlaid on the reference line, the calculator calculates the feeding error correction signal in accordance with the distance, and the controller drives the feeding roller to feed the printing sheet according to the feeding error correction signal.

24. The image forming device as claimed in claim 14, wherein the calculator calculates a feeding amount represented by the following formula feeding amount=normal feed distance+$(r+d)\times\theta$, wherein r is a radius of the feeding roller, d is a thickness of the printing sheet, and $\theta$ is a feeding angle of the feeding roller, and the controller controls the feeding roller to feed the printing sheet according to the feeding amount.

25. The image forming device as claimed in claim 14, wherein the calculator calculates a feeding amount represented by the following formula:

feeding amount=(r+a reference thickness of a reference sheet+a thickness difference between the reference sheet and the printing sheet)$\times\theta$, wherein r is a radius of the feeding roller, and $\theta$ is a feeding angle of the feeding roller, and the controller controls the feeding roller to feed the printing sheet according to the feeding amount.

26. The image forming device as claimed in claim 14, wherein the number of rollers represents the number of rollers contacting the printing sheet.

27. The image forming device as claimed in claim 14, wherein the device comprises a paper passageway on which the rollers are disposed, the paper passageway comprises a first section where the printing sheet is inserted in the pickup roller and the feeding roller, a second section where the printing sheet is inserted in the pickup roller, the feeding roller, and the exit roller, a third section where the printing sheet is inserted in the feeding roller and the exit roller, and a fourth section where the printing sheet is inserted in the exit roller, and the controller drives the feeding roller upon determining that the printing sheet is in one of the first, second, third, and fourth sections of the paper passageway.

28. An image forming device feeding a printing sheet of paper using rollers including a pickup roller, a feeding roller, and an exit roller, comprising:

a calculator calculating an error correction value according to the number of the rollers contacting the printing sheet; and a controller driving one of the rollers according to the error correction value of the calculator.

29. An image forming device feeding a printing sheet of paper using rollers including a pickup roller, a feeding roller, and an exit roller, comprising:

a calculator calculating an error correction value according to the number of the rollers contacting the printing sheet, one of printing modes, and a characteristic of the printing sheet; and a controller driving the feeding roller according to the error correction value of the calculator.

30. A vertical alignment correction method for an image forming device feeding a printing sheet of paper using rollers including a pickup roller, a feeding roller, and an exit roller, comprising:

calculating an error correction value according to the number of the rollers feeding the printing sheet; and driving one of the rollers according to the error correction value.

31. The vertical alignment correction method as claimed in claim 30, wherein the calculating of the error correction value comprises:

calculating the error correction value according to one of printing modes.

32. The image forming device as claimed in claim 30, wherein the calculating of the error correction value comprises:

calculating the error correction value according to a characteristic of the printing sheet.

33. A vertical alignment correction method in an image forming device feeding a printing sheet of paper using rollers including a pickup roller, a feeding roller, and an exit roller, comprising:

calculating an error correction value according to the number of the rollers contacting the printing sheet, one of printing modes, and a characteristic of the printing sheet; and driving the feeding roller according to the error correction value.

34. An image forming device feeding printing sheets of paper using rollers, comprising:

a calculator calculating an error correction value according to an optimum state of printing position sections, print modes, and the printing sheets to eliminate a vertical alignment difference during printing the printing sheet; and a controller driving one of the rollers according to the error correction value of the calculator.

35. An image forming device feeding printing sheets of paper using rollers, comprising:

a calculator calculating an error correction value depending upon print modes, the printing sheets, and printing position sections to correct a vertical alignment difference; and a controller driving one of the rollers according to the error correction value of the calculator.

* * * * *